US009390651B2

(12) United States Patent
Bang et al.

(10) Patent No.: US 9,390,651 B2
(45) Date of Patent: Jul. 12, 2016

(54) ORGANIC LIGHT EMITTING DISPLAY AND METHOD FOR OPERATING THE SAME

(71) Applicants: Hyun-Chol Bang, Yongin (KR); Yang-Wan Kim, Yongin (KR)

(72) Inventors: Hyun-Chol Bang, Yongin (KR); Yang-Wan Kim, Yongin (KR)

(73) Assignee: SAMSUNG DISPLAY CO., LTD., Yongin, Gyunggi-do (KR)

( * ) Notice: Subject to any disclaimer, the term of this patent is extended or adjusted under 35 U.S.C. 154(b) by 467 days.

(21) Appl. No.: 13/793,573

(22) Filed: Mar. 11, 2013

(65) Prior Publication Data

US 2014/0152639 A1 Jun. 5, 2014

(30) Foreign Application Priority Data

Dec. 5, 2012 (KR) ..... 10-2012-0140273

(51) Int. Cl.
*G09G 3/32* (2006.01)

(52) U.S. Cl.
CPC ..... *G09G 3/3233* (2013.01); *G09G 3/3291* (2013.01); *G09G 2300/0426* (2013.01); *G09G 2300/0842* (2013.01); *G09G 2300/0861* (2013.01); *G09G 2310/0297* (2013.01)

(58) Field of Classification Search
CPC ..... G09G 2300/0426; G09G 2300/0861; G09G 2300/0842; G09G 2310/0297; G09G 3/3291; G09G 3/3233
See application file for complete search history.

(56) References Cited

U.S. PATENT DOCUMENTS

| | | | | |
|---|---|---|---|---|
| 8,089,477 | B2 * | 1/2012 | Shirouzu et al. | 345/212 |
| 8,174,514 | B2 * | 5/2012 | Kim | 345/204 |
| 2007/0057877 | A1 * | 3/2007 | Choi et al. | 345/76 |
| 2007/0242016 | A1 | 10/2007 | Choi | |
| 2009/0207104 | A1 | 8/2009 | Lee | |
| 2010/0164926 | A1 * | 7/2010 | Huang et al. | 345/211 |

FOREIGN PATENT DOCUMENTS

| | | | |
|---|---|---|---|
| KR | 10-2007-0102861 | A | 10/2007 |
| KR | 10-2009-0090117 | A | 8/2009 |

* cited by examiner

*Primary Examiner* — Abbas Abdulselam
(74) *Attorney, Agent, or Firm* — Lee & Morse, P.C.

(57) ABSTRACT

An organic light emitting display device includes: a pixel unit including first pixels positioned at intersection parts between first data lines and first scan lines and the second pixels positioned at intersection parts between the second data lines and the second scan lines; a scan driver sequentially supplying first scan signals to the first scan lines and sequentially supplying second scan signals to the second scan lines; a data driver supplying first output signals to first output lines and supplying second output signals to second output lines; and a demultiplexer block unit including demultiplexers which demultiplex the first output signals in response to control signals, respectively, and supply the demultiplexed signals to the first data lines, wherein the second output lines are directly connected to the second data lines.

20 Claims, 4 Drawing Sheets

ORGANIC LIGHT EMITTING DISPLAY AND METHOD FOR OPERATING THE SAME

CROSS-REFERENCE TO RELATED APPLICATION

This application claims priority to and the benefit of Korean Patent Application No. 10-2012-0140273, filed on Dec. 5, 2012, in the Korean Intellectual Property Office, the entire content of which is incorporated herein by reference.

BACKGROUND

1. Field

Embodiments relate to an organic light emitting display and method for operating the same.

2. Description of the Related Art

Recently, various flat panel displays capable of reducing weight and volume, which are disadvantages of cathode ray tubes, have been developed. Example of flat panel displays, include liquid crystal displays, field emission displays, plasma display panels, organic light emitting displays, and the like.

Organic light emitting displays display an image using an organic light emitting diode (OLED) generating light by recombination of electrons and holes. The organic light emitting display has advantages including a fast response speed and low power consumption. In a general organic light emitting display, a driving transistor included in each of pixels supplies a magnitude of current corresponding to a data signal to the organic light emitting diode, so as to emit light from the organic light emitting diode.

Organic light emitting displays typically use a demultiplexer in order to reduce the number of output lines of a data driver. For example, the data driver of the organic light emitting display sequentially supplies three data signals to each of the output lines, demultiplexes the three data signals using the demultiplexer, and supplies the demultiplexed signals to the data lines connected to the pixels.

SUMMARY

One or more embodiments are directed to providing an organic light emitting display device that may include: a pixel unit including first pixels positioned at intersection parts between first data lines and first scan lines and the second pixels positioned at intersection parts between the second data lines and the second scan lines; a scan driver sequentially supplying first scan signals to the first scan lines and sequentially supplying second signals to the second scan lines; a data driver supplying first output signals to first output lines and supplying second output signals to second output lines; and a demultiplexer block unit including demultiplexers which demultiplex the first output signals in response to control signals, respectively, and supply the demultiplexed signals to the first data lines, wherein the second output lines are directly connected to the second data lines.

The first pixels, in response to the first scan signals, may charge a magnitude of voltage corresponding to the first data signals supplied through the first data lines to a first storage capacitor included in the first pixels. The second pixels, in response to the second scan signals, may charge voltage corresponding to the second data signals supplied through the second data lines to a second storage capacitor included in the second pixels.

Each of the demultiplexers may includes a first switching device controlling connection between any one of the first data lines and the first output line in response to a first control signal among the control signals; and a second switching device controlling connection between another of first data lines and the first output line in response to a second control signal among the control signals.

The first control signal and the second control signal may be sequentially supplied, and each of the first scan signals may be supplied after the first control signal and the second control signal are supplied Each of the first pixels may include a red light organic light emitting diode or a blue light organic light emitting diode, and the second pixels include a green organic light diode.

The organic light emitting display may further include a timing controller controlling the scan driver and the data driver and supplying the control signals.

One or more embodiments are directed to providing an operating method of an organic light emitting display. The method may include: demultiplexing a first output signal supplied through the first output lines in response to control signals during a first period among horizontal periods and supplying the demultiplexed signal to first data lines; charging a magnitude of voltage corresponding to the first data signals supplied through the first data lines to a first storage capacitor included in the first pixels during a second period among the horizontal periods; and charging voltage corresponding to the second output signal supplied through the second output line to a second storage capacitor included in the second pixel during the horizontal period.

Supplying the demultiplexed signal to the first data lines may include demultiplexing the first output signal in response to the control signals; and storing the demultiplexing signals to the data capacitors as the first data signals.

Demultiplexing the first output signal in response to the control signals may include: connecting the first output line to any one of the first data lines in response to a first control signal among the control signals; and connecting the first output line to another of first data lines in response to a second control signal among the control signals.

The horizontal period may include the first period and the second period, wherein the second period begins after the first period.

Each of the first pixels may include a red light organic light emitting diode or a blue light organic light emitting diode, and the second pixel may include a green organic light diode.

DETAILED DESCRIPTION

Figure 1:
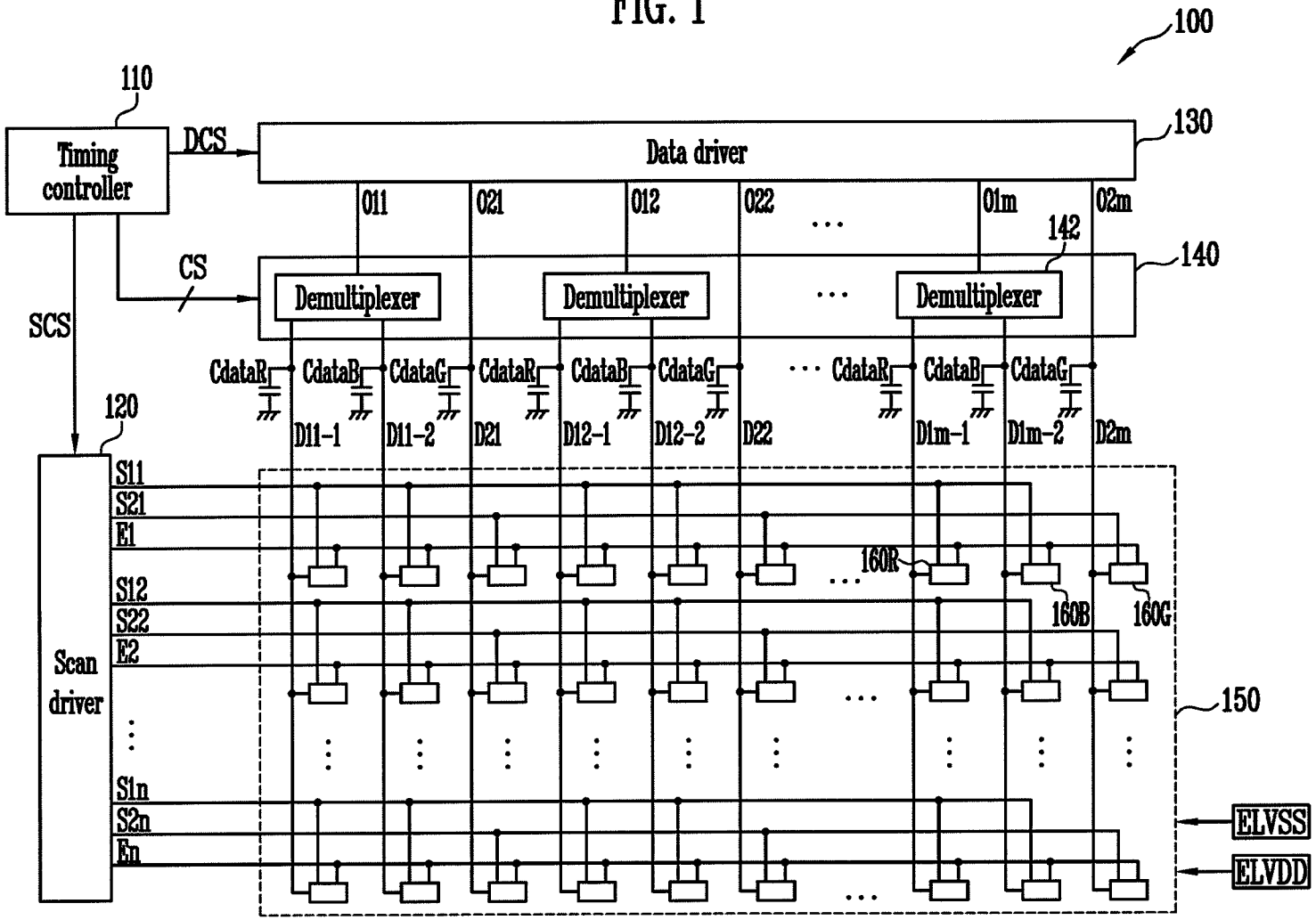
FIG. 1 is a view showing an organic light emitting display according to an embodiment.

In the following detailed description, only certain exemplary embodiments of have been shown and described, simply by way of illustration. As those skilled in the art would realize, the described embodiments may be modified in various different ways, all without departing from the spirit or scope of the present disclosure. Accordingly, the drawings and description are to be regarded as illustrative in nature and not restrictive. In addition, when an element is referred to as being "on" another element, it can be directly on the another element or be indirectly on the another element with one or more intervening elements interposed therebetween. Also, when an element is referred to as being "connected to" another element, it can be directly connected to the another element or be indirectly connected to the another element with one or more intervening elements interposed therebetween. Hereinafter, like reference numerals refer to like elements.

Hereinafter, embodiments will be described in detail with reference to the accompanying drawings.

FIG. 1 is a view showing an organic light emitting display according to an embodiment. Referring to FIG. 1, the organic light emitting display 100 includes a timing controller 110, a scan driver 120, a data driver 130, a demultiplexer block unit 140, a plurality of data capacitors Cdata, and a pixel unit 150.

As shown in FIG. 1, each demultiplexer 142 in the demultiplexer block unit 140 is a 1:2 demultiplexer, i.e., each demultiplexer demultiplexes one input signal into two output signals. However, embodiments are not limited thereto. For example, each of the demultiplexers 142 may be a 1:i (i indicates a natural number of 2 or more) demultiplexer.

The timing controller 110 controls the scan driver 120, the data driver 130, and the demultiplexer block unit 140, and rearranges data supplied from the outside and outputs the rearranged data to the data driver 130. Specifically, the timing controller 110 generates a scan driving control signal SCS, a data driving control signal DCS, and a control signals CS in response to a synchronization signal (not shown) supplied from the outside. The timing controller 110 outputs the generated scan driving control signal SCS to the scan driver 120, outputs the generated data driving control signal DCS and rearranged data to the data driver 130, and outputs the generated control signals CS to the demultiplexer block unit 140.

The scan driver 120, in response to the scan driving control signal SCS output from the timing controller 110, sequentially supplies first scan signals to the pixel unit 150 through the first scan lines S11 to S1*n*, and sequentially supplies second scan signals to the pixel unit 150 through the second scan signals S21 to S2*n*. The first scan signals are supplied during a second period (P2 of FIG. 4) of the first horizontal period (1H of FIG. 4) and the second scan signals are supplied during the first horizontal period 1H.

Also, the scan driver 120 sequentially supplies emission control signals to the pixel unit 150 through emission control lines E1 to En. The emission control signals are not supplied during the first horizontal period 1H so as not to emit the light in a pixel 160.

The data driver 130, in response to the data driving control signal DCS output from the timing controller 110, supplies first output signals to first output lines O11 to O1*m* and supplies second output signals to second output lines O21 to O2*m*.

The first output lines O11 to O1*m*connects the data driver 130 and the demultiplexers 142 to each other, and the second output lines O21 to O2*m* directly connects the data driver 130 and the pixel unit 150 to each other.

Each of the first output signals includes data corresponding to i (i indicates a natural number of 2 or more) pixel during the first horizontal period 1H. Each of the second output signals includes data corresponding to the one pixel during the first horizontal period 1H. For example, when the demultiplexer 142 is a 1:2 demultiplexer, the first output signals include two data signals (R and B of FIG. 4) and the second output signals include one data signal (G of FIG. 4).

The demultiplexer block unit 140, in response to the control signals CS output from the timing controller 110, demultiplexes the first output signals and supplies the demultiplexed signals to the pixel unit 150 through first data lines D11-1 to D1*m*-1 and D11-2 to D1*m*-2.

The demultiplexer block unit 140 includes the plurality of the demultiplexers 142. Each of the demultiplexers 142, in response to the control signals CS output from the timing controller 110, demultiplexes one of the first output signals, and supplies the demultiplexed signal to the pixel unit 150.

Data capacitors CdataR, CdataB, and CdataG are positioned at each of the data lines D11-1 to D1*m*-1, D11-2 to D1*m*-2, and D21 to D2*m*. The data capacitors CdataR, CdataB, and CdataG temporally store data signals supplied through the data lines D11-1 to D1*m*-1, D11-2 to D1*m*-2, and D21 to D2*m*, and supply the stored data signals to the pixel unit 150.

Each of the data capacitors CdataR, CdataB, and CdataG may be implemented as a parasitic capacitor which is formed on each of the data lines D11-1 to D1*m*-1, D11-2 to D1*m*-2, and D21 to D2*m*. Since the parasitic capacitor which formed on each of the data lines D11-1 to D1*m*-1, D11-2 to D1*m*-2, and D21 to D2*m* has capacitance higher than a storage capacitor (Cst of FIG. 2) formed in the pixels 160, the data signals may be stably stored.

The pixel unit 150 includes first pixels 160R and 160B positioned at each of the intersections between the first scan lines S11 to S1*n* and the first data lines D11-1 to D1*m*-1 and D11-2 to D1*m*-2, and second pixels 160G positioned at each of the intersections between the second scan lines S21 to S2*n* and second data lines D21 to D2*m*.

The first pixels 160R and 160B respectively receives a first power ELVDD and a second power ELVSS from the outside. When the first scan signal is supplied, voltage corresponding to the first data signals is charged to the storage capacitors Cst included in each of the first pixels 160R and 160B. Also, each of the second pixels 160G receives the first power ELVDD and the second power ELVSS from the outside. When the second scan signal is supplied, voltage corresponding to the second data signals is charged to the storage capacitors Cst included in each of the second pixels 160G. Each of the first pixels 160R and 160B and the second pixels 160G generates light of brightness corresponding to a magnitude of the voltage charged in the storage capacitors Cst after the first horizontal period 1H.

Figure 2:
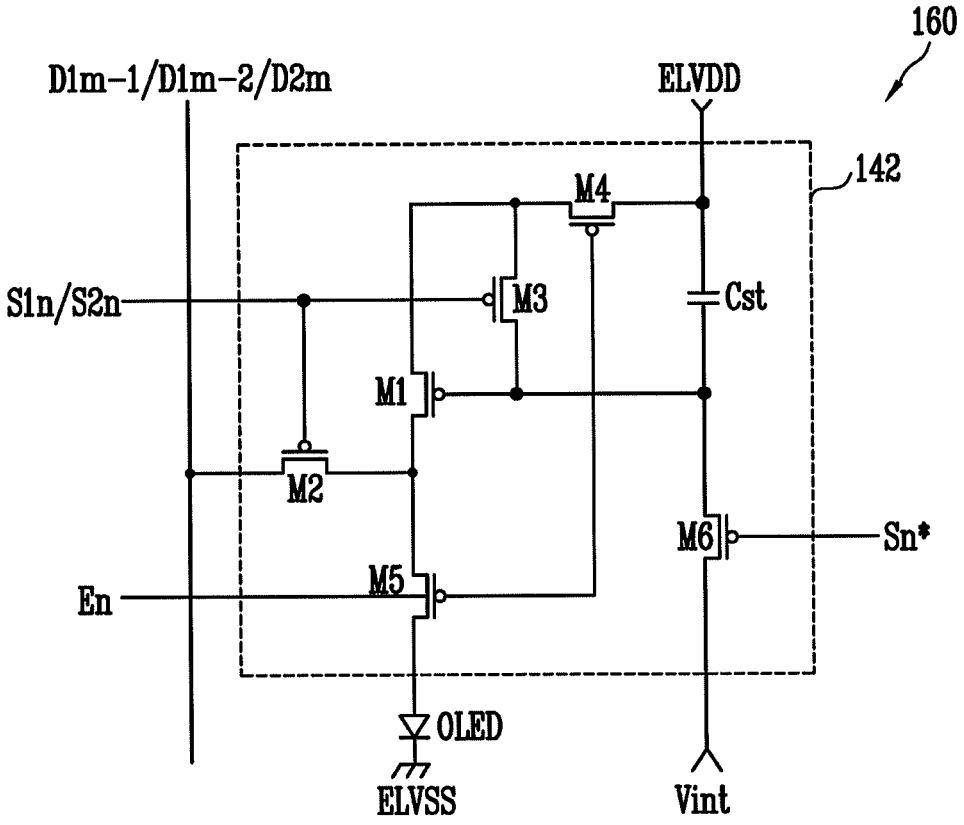
FIG. 2 is a circuit diagram showing an exemplary embodiment of a pixel shown in FIG. 1.
Figure 4:
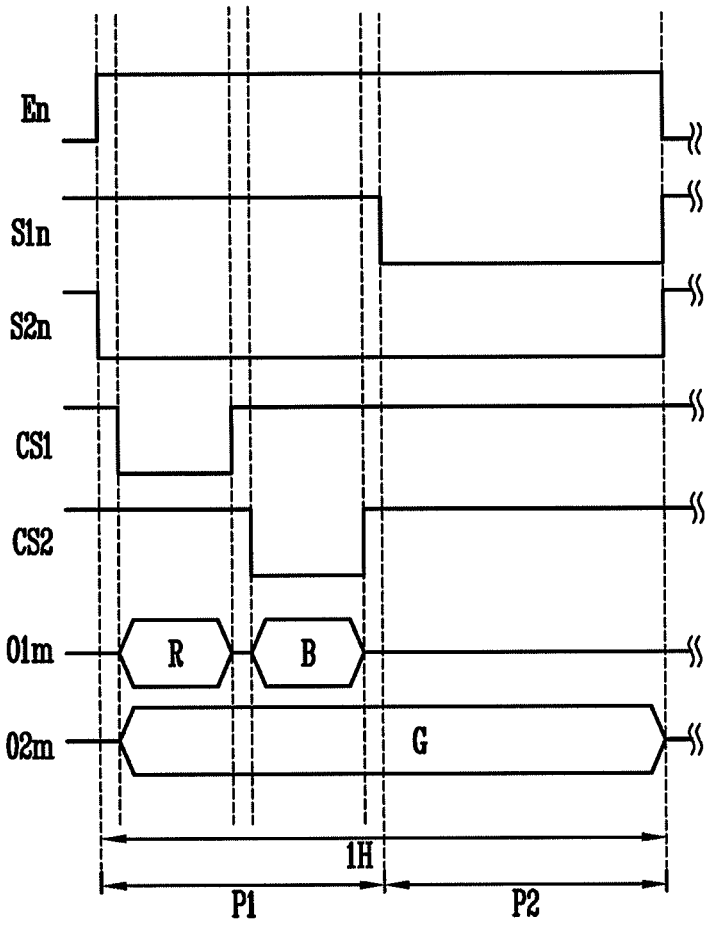
FIG. 4 is a waveform diagram describing an operation of an organic light emitting display according to an embodiment.

FIG. 2 is a circuit diagram showing an exemplary embodiment of a pixel shown in FIG. 1. The circuit diagram of FIG. 2 only shows a representative structure of the pixel, and embodiments are not limited thereto. For example, while the transistors M1 to M6 are p-type transistors in FIG. 2, each of the transistors M1 to M6 may be implemented as a n-type transistors. When the transistors M1 to M6 are n-type transistors, polarity of waveforms shown in FIG. 4 is inverted.

Referring FIG. 2, each reference numeral of the pixels 160R, 160B, and 160G is collectively designated as 160, hereinafter. Each of the pixels includes an organic light emitting diode OELD and a pixel circuit 142.

The organic light emitting diode OLED is connected between the pixel circuit 142 and the second power supply ELVSS. Here, voltage of the second power supply ELVSS is set to be lower than that of the first power supply ELVDD, e.g., a ground voltage.

The organic light emitting diode OLED generates light of brightness corresponding to a magnitude of the current supplied from the pixel circuit 142. For example, the organic light emitting diode OLED generates red light, green light, or blue light.

The pixel circuit 142 is connected to the first power supply ELVDD, an initialization power Vint, the data line D1*m*-1, D1-2, or D2*m*, scan lines S1*n* or S2*n* and Sn*, the emission control line En, and the organic light emitting diode OLED. For example, the pixel circuit 142 included in the first pixel 140R is connected to the first power supply ELVDD, the initialization power Vint, the first data line D1*m*-1, the scan lines S1*n* and Sn*, the emission control line En the organic light emitting diode OLED; the pixel circuit 142 included in the first pixel 140B is connected to the first power supply ELVDD the initialization power Vint, the first data line D1*m*-2, the scan lines S1*n* and Sn*, the emission control line En, and the organic light emitting diode OLED; and the pixel circuit 142 included in the second pixel 140G is connected to the first power supply ELVDD, the initialization power Vint, the second data line D2*m*, the scan lines S2*n* and Sn*, the emission control line En, and the organic light emitting diode OLED.

The pixel circuit 142 controls the current flowing from the first power supply ELVDD to the second power supply ELVSS through the organic light emitting diode OLED. The pixel circuit 142 includes the storage capacitor Cst and the transistors M1 to M6.

The storage capacitor Cst and the sixth transistor M6 are connected between the first power supply ELVDD and the initialization power Vint; the fourth transistor M4, the first transistor M1, and the fifth transistor are connected between the first power supply ELVDD and the organic light emitting diode OLED, the third transistor M3 is connected between a first electrode of the first transistor M1 and a gate electrode of the first transistor M1; the second transistor M2 is connected between a second electrode of the first transistor M1 and the data line D1*m*-1, D1*m*-2, or D2*m*.

Here, the first electrode is one of a drain electrode and a source electrode, and the second electrode is another of the source and drain electrode. For example, when the first electrode is the source electrode, the second electrode is set to be the drain electrode.

The first transistor M1 supplies a magnitude of the current corresponding to the voltage charged in the storage capacitor Cst to the organic light emitting diode OLED. The first electrode of the first transistor M1 is connected to the first power supply ELVDD through the fourth transistor M4, the second electrode thereof is connected to the organic light emitting diode OLED through the fifth transistor M5, and the gate electrode thereof is connected to the storage capacitor Cst.

The second transistor M2, in response to the scan signal supplied through the scan line S1*n* or S2*n*, supplies the data signal supplied through the data line D1*m*-1, D1*m*-2 or D2*m* to the second electrode of the first transistor M1. A first electrode of the second transistor M2 is connected to the data line D1*m*-1, D1*m*-2, or D2*m*, a second electrode thereof is connected to the second electrode of the first transistor M1, and a gate electrode thereof is connected to the scan line S1*n* or S2*n*.

For example, when the pixel 160 is one of the first pixels 160R and 160B shown in FIG. 1, the second transistor M2 supplies the first data signal supplied through the data line D1*m*-1 or D2*m* to the second electrode of the first transistor M1 in response to the first scan signal supplied through the first scan line S1*n*.

As another example, when the pixel 160 is one of the second pixels 160G shown in FIG. 1, the second transistor M2 supplies the first data signal supplied through the second data line D2*m* to the second electrode of the first transistor M1 in response to the second scan signal supplied through the second scan line S2*n*.

The third transistor M3, in response to the scan signal supplied through the scan line S1*n* or S2*n*, connects the first electrode and the gate electrode of the first transistor M1 to each other. That is, when the third transistor M3 is turned on, the first transistor M1 operates as a diode. A first electrode of the third transistor M3 is connected to the first electrode of the first transistor M1, a second electrode thereof is connected to the gate electrode of the first transistor M1, and a gate electrode thereof is connected to the scan line S1*n* or S2*n*.

The fourth transistor M4, in response to the emission control signal supplied through the emission control line En, controls a connection between the first power supply ELVDD and the first transistor M1. The fourth transistor M4 is turned on when the emission control signal is not supplied, that is, when the emission control signal having low level is supplied. The fourth transistor electrically connects the first power supply ELVDD and the first transistor M1 to each other. A first electrode of the fourth transistor M4 is connected to the first power supply ELVDD and a second electrode thereof is connected to the first electrode of the first transistor M1, a gate electrode thereof is connected to the emission control line En.

The fifth transistor M5 controls a connection between the first transistor M1 and the organic light emitting diode OLED in response to the emission control signal. The fifth transistor M5 is turned on when the emission control signal is not supplied, that is, when the emission control signal having low level is supplied. The fifth transistor electrically connects the first transistor M1 and the organic light emitting diode OLED to each other. A first electrode of the fifth transistor M5 is connected to the first transistor M1, and a second electrode thereof is connected to the organic light emitting diode OLED, and a gate electrode thereof is connected to the emission control line En.

The sixth transistor M6, in response to the scan signal supplied through the scan line S1*, initializes the storage capacitor Cst and the gate electrode of the first transistor M1 by an initialization power Vint. A voltage value of the initialization power Vint is set to be lower than that of the data signal. A first electrode of the sixth transistor M6 is connected to the storage capacitor Cst and the gate electrode of the first transistor M1, a second electrode thereof is connected to the initialization power Vint, and a gate electrode thereof is connected to the scan line Sn*. The scan line Sn* may be any one of the scan lines S11 to S1*n* and S21 to S2*n*, other than the scan line S1*n* and S2*n*.

Figure 3:
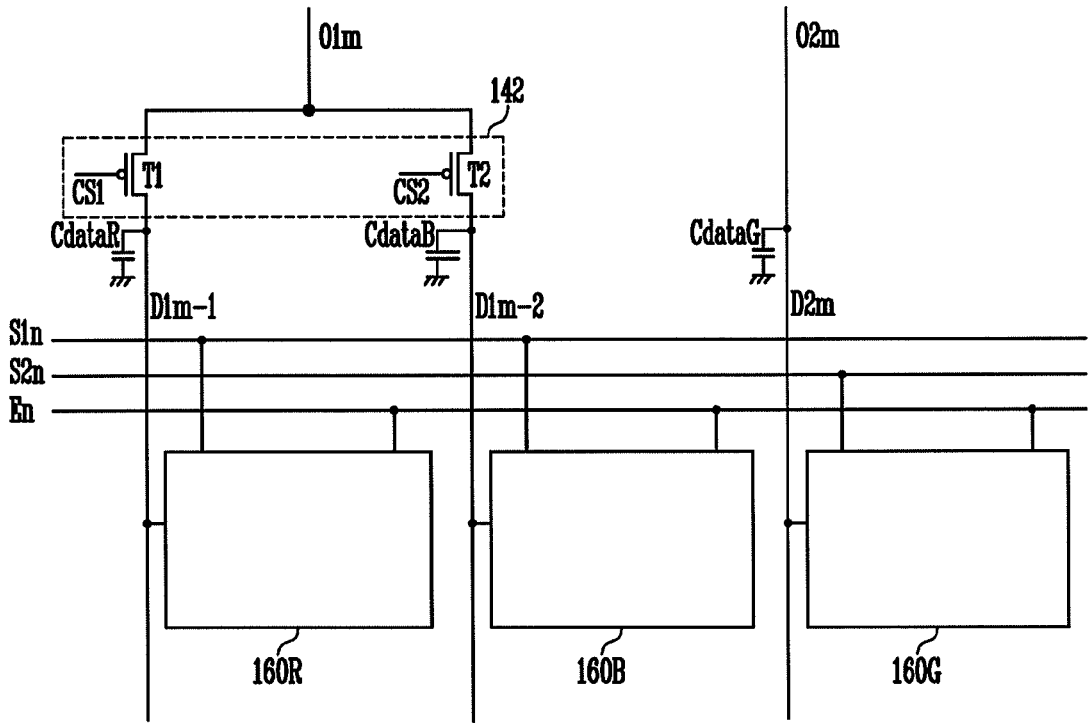
FIG. 3 is a circuit diagram showing an exemplary embodiment of a coupling structure of a demultiplexer block unit and pixels shown in FIG. 1.

FIG. 3 is a circuit diagram showing an exemplary embodiment of a coupling structure of a demultiplexer block unit and pixels shown in FIG. 1. For convenience of description, the data capacitors CdataR, CdataB, CdataG are shown together in FIG. 3. For convenience of description, only the 1:2 demultiplexer 142 of the demultiplexer block unit 140 is shown in FIG. 3.

Referring to FIGS. 3 and 4, the demultiplexer 142 demultiplexes the first output signal supplied through the first output line O1*m* into the first data signals in response to the control signals CS1 and CS2, and supplies the demultiplexed first output signals to the first pixels 160R and 160B through the first data lines D1*m*-1 and D1*m*-2. In addition, the second output line O2*m* and the second data line D2*m* are directly connected to each other, the second output signal through the second output line O2*m* is supplied to the second data line D2*m* as a second data signal.

The demultiplexer 142 includes a plurality of switching devices T1 and T2. The first switching device T1 controls a connection between the first output line O1*m* and one data line D1*m*-1 of the first data lines D1*m*-1 and D1*m*-2 in response to the first control signal CS1, and the second switching device T2 controls a connection between the first output line O1*m* and another data line D1*m*-2 of the said first data lines D1*m*-1 and D1*m*-2 in response to the second control signal CS2.

Each of the first pixels 160R and 160B is connected between any one of the first data lines D1*m*-1 and D1*m*-2 and the first scan line S1*n*, and the second pixel 160G is connected between the second data line D2*m* and the second scan line S2*n*.

The first pixels 160R and 160B and the second pixel 160G may emit red light, blue light, or green light, respectively. For example, the first pixel 160R may emit the red light of brightness corresponding to the data signal R which is supplied through one data line D1*m*-1 of the first data lines, the first pixel 160B may emit the blue light of brightness corresponding to the data signal B which is supplied through another data line D1*m*-2 of the first data lines, the second pixel 160G may emit the green light of brightness corresponding to the data signal G which is supplied through the second D2*m*.

Since green light has the best visibility. i.e., light to which the human eye is most sensitive, among red light, blue light, and green light, the second pixel 160G having data input period longer than that of the first pixels 160R and 160B may emit the green light, however, embodiments are not limited thereto.

FIG. 4 is a waveform diagram showing an operation of an organic light emitting display according to the embodiment. Referring to FIG. 4, the emission control signal supplied through the emission control line En is not supplied during the first horizontal period 1H. That is, the emission control signal maintains high level during the first horizontal period 1H. Therefore, the pixels 160R, 160B, and 160G does not emitted during the first horizontal period 1H.

Each of the control lines CS1 and CS2 are sequentially supplied during the first period P1. That is, after the first control signal CS1 is supplied, then the second control signal CS2 is supplied.

While the first control signal CS1 is supplied, the first switching device T1 connects the first output line O1*m* and the data line D1*m*-1 to each other. Therefore, the data capacitor CdataR is charged with voltage corresponding to the data signal R supplied through the first data line D1*m*-1.

While the first control signal CS1 is blocked and the second control signal CS2 is supplied, the second switching device T2 connects the first output line O1*m* and the data line D1*m*-2 to each other. Therefore, the data capacitor CdataB is charged with voltage corresponding to the data signal B supplied through the first data line D1*m*-2.

The first scan signal supplied through the first scan line S1*n* is supplied during the second period P2. That is, the first scan signal maintains low level during the second period P2. In this case, the first pixel 160R charges the voltage stored in the data capacitor CdataR to the storage capacitor Cst included in the first pixel 160R. In this case, the first pixel 160B charges the voltage stored in the data capacitor CdataB to the storage capacitor Cst included in the first pixel 160B.

The second scan signal supplied through the second scan line S2*n* is supplied during the first horizontal period 1H. That is, the second scan signal maintains low level during the first horizontal period 1H. In this case, the second pixel 160G charges voltage corresponding to the second data signal G supplied through the second data line D2*m* to the storage capacitor Cst included in the second pixel 160G.

When the emission control signal is supplied through the emission control line En after the first horizontal period 1H, the first pixels 160R and 160B and the second pixel 160G respectively generates light of brightness corresponding to the voltage charged in the storage capacitor Cst.

By way of summation and review, as set forth above, the organic light emitting display and method for operating the same according to embodiments, there is an effect to operate the organic light emitting display at high resolution without an error by reducing the number of output lines of a data driver and sufficiently securing a scan period during a first horizontal period.

In contrast, in the organic light emitting display according to the related art, since three data signals are sequentially input thereto, a data input period is increased and a scan period is reduced during a first horizontal period. Therefore, the organic light emitting display according to the related art, an error may occur at high resolution due to a short first horizontal period.

While the present invention has been described in connection with certain exemplary embodiments, it is to be understood that the invention is not limited to the disclosed embodiments, but, on the contrary, is intended to cover various modifications and equivalent arrangements included within the spirit and scope of the appended claims, and equivalents thereof.

What is claimed is:

1. An organic light emitting display, comprising:

a pixel unit including first pixels positioned at intersections between first data lines and first scan lines, and second pixels positioned at intersections between second data lines and second scan lines;

a scan driver to supply sequentially first scan signals to the first scan lines and to supply sequentially second scan signals to the second scan lines;

a data driver to supply first output signals to first output lines and to supply second output signals to second output lines; and a demultiplexer block unit including demultiplexers to demultiplex the first output signals in response to control signals, respectively, and supply the demultiplexed signals to the first data lines, wherein the second output lines are connected to the second data lines along signal paths that bypass the demultiplexers, wherein each of the second output lines is between adjacent ones of the first data lines.

2. The organic light emitting display according to the claim 1, wherein:

the first pixels, in response to the first scan signals, charge a magnitude of the voltage corresponding to first data signals supplied through the first data lines to a first storage capacitor included in the first pixels, and the second pixels, in response to the second scan signals, charge a magnitude of voltage corresponding to second data signals supplied through the second data lines to a second storage capacitor included in the second pixels.

3. The organic light emitting display according to the claim 1, wherein each of the demultiplexers includes:

a first switching circuit to control a connection between any one of the first data lines and the first output line in response to a first control signal among the control signals; and a second switching circuit to control a connection between another of the first data lines and the first output line in response to a second control signal among the control signals.

4. The organic light emitting display according to the claim 3, wherein the first control signal and the second control signal are sequentially supplied, and each of the first scan signals is supplied after the first control signal and the second control signal are supplied.

5. The organic light emitting display according to the claim 1, wherein the first pixels include a red light organic light emitting diode or a blue light organic light emitting diode, and the second pixels include a green organic light diode.

6. The organic light emitting display according to the claim 1 further comprising: a timing controller to control the scan driver and the data driver, and supply the control signals.

7. An operating method of an organic light emitting display including first pixels and a second pixel, the method comprising:

demultiplexing, through a demultiplexer, a first output signal supplied through a first output line in response to control signals during a first period of a horizontal period and supplying the demultiplexed signal to first data lines;

charging magnitudes of voltages corresponding to the first data signals supplied through the first data lines to a first storage capacitor included in corresponding ones of the first pixels during a second period in the horizontal period; and charging a magnitude of a voltage corresponding to a second output signal supplied through the second output line to a second storage capacitor included in the second pixel during the horizontal period, wherein the second output signal is supplied to the second storage capacitor through the second output line along a signal path that bypasses the demultiplexer.

8. The operating method of the organic light emitting display according to the claim 7, wherein supplying the demultiplexed signal to the first data lines includes:

demultiplexing the first output signal in response to the control signals; and storing the demultiplexed signals in data capacitors as the first data signals.

9. The operating method of the organic light emitting display according to the claim 8, wherein demultiplexing the first output signal in response to the control signals includes:

connecting the first output line to any one of the first data lines in response to a first control signal among the control signals; and connecting the first output line to another of first data lines in response to a second control signal among the control signals.

10. The operating method of the organic light emitting display according to the claim 7, wherein:

the horizontal period includes the first period and the second period, and the second period is after the first period.

11. The operating method of the organic light emitting display according to the claim 7, wherein each of the first pixels includes a red light organic light emitting diode or a blue light organic light emitting diode, and each of the second pixels includes a green organic light diode.

12. An apparatus, comprising:

a first pixel;

a second pixel;

a third pixel; and a demultiplexer between a first output line and first and second data lines, the demultiplexer to demultiplex a first output signal from the first output line to the first data line based on a first control signal and to demultiplex a second output signal from the first output line to the second data line based on a second control signal, wherein the first pixel is connected to the first data line, the second pixel is connected to the second data line, and the third pixel is connected to a third data line, the third data line connected to a second output line along a signal path that bypassses the demultiplexer.

13. The apparatus as claimed in claim 12, further comprising:

a data driver to output the first and second output signals to the first output line and a third output signal to the second output line.

14. The apparatus as claimed in claim 12, further comprising:

a first capacitor between the demultiplexer and the first pixel, the first capacitor to store a data voltage based on the first output signal;

a second capacitor between the demultiplexer and the second pixel, the second capacitor to store a data voltage based on the second output signal; and a third capacitor connected along the signal path to store a data voltage based on a third output signal.

15. The apparatus as claimed in claim 14, wherein each of the first, second, and third capacitors is a parasitic capacitor.

16. The apparatus as claimed in claim 15, wherein the parasitic capacitor is formed by two adjacent ones of the first, second, or third data lines.

17. The apparatus as claimed in claim 14, wherein the first, second, and third capacitors are different from storage capacitors in respective ones of the first, second, and third pixels.

18. The apparatus as claimed in claim 17, wherein the first, second, and third capacitors having higher capacitances than the storage capacitors in respective ones of the first, second, and third pixels.

19. The apparatus as claimed in claim 12, wherein:

the first and second output signals are to be demultiplexed during a first period;

a third output signal is to be output to the third data line during a second period;

the second period is longer than the first period, and the first, second, and third periods are different from an emission period.

20. The apparatus as claimed in claim 19, wherein the second period is longer than the first period.

* * * * *